US011592232B2

(12) United States Patent
Dhande et al.

(10) Patent No.: US 11,592,232 B2
(45) **Date of Patent: *Feb. 28, 2023**

(54) REFRIGERATION WATER DISPENSING SYSTEM

(71) Applicant: WHIRLPOOL CORPORATION, Benton Harbor, MI (US)

(72) Inventors: Swapnil R. Dhande, Wardha (IN); Deepak Dilipsingh Dixit, Nagpur (IN); Pranav Madhup, Chapra (IN)

(73) Assignee: Whirlpool Corporation, Benton Harbor, MI (US)

( * ) Notice: Subject to any disclaimer, the term of this patent is extended or adjusted under 35 U.S.C. 154(b) by 407 days.

This patent is subject to a terminal disclaimer.

(21) Appl. No.: 16/905,149

(22) Filed: Jun. 18, 2020

(65) Prior Publication Data

US 2020/0318891 A1 Oct. 8, 2020

Related U.S. Application Data

(63) Continuation of application No. 15/873,554, filed on Jan. 17, 2018, now Pat. No. 10,697,700.

(51) Int. Cl.

| | |
|---|---|
| ***F25D 23/12*** | (2006.01) |
| ***F25D 29/00*** | (2006.01) |
| *F25D 23/02* | (2006.01) |

(52) U.S. Cl.

CPC ..... *F25D 23/126* (2013.01); *F25D 29/005* (2013.01); *F25D 23/028* (2013.01); *F25D 2323/122* (2013.01)

(58) Field of Classification Search

CPC .... F25D 23/126; F25D 23/028; F25D 29/005; F25D 2323/122

See application file for complete search history.

(56) References Cited

U.S. PATENT DOCUMENTS

| | | | |
|---|---|---|---|
| 2,934,023 | A | 4/1960 | Lamkin et al. |
| 3,129,711 | A | 4/1964 | Schmitt-Matzen |
| 3,359,907 | A | 12/1967 | Bochan |

(Continued)

FOREIGN PATENT DOCUMENTS

| | | |
|---|---|---|
| CH | 707892 | 10/2014 |
| CN | 202630562 U | 12/2012 |

(Continued)

*Primary Examiner* — Emmanuel E Duke
(74) *Attorney, Agent, or Firm* — Price Heneveld LLP

(57) ABSTRACT

A water dispensing system for a refrigeration appliance includes a three-way connector operably coupled to an inlet water source and configured to direct incoming water from the inlet water source into an ambient water holding portion and a cold water tank. A water dispenser is coupled with said refrigeration appliance. A three-way control valve is configured to provide water to the water dispenser from at least one of the ambient water holding portion and the cold water tank. A valve actuator is slidable between first, second, and third positions. The three-way control valve is configured to provide water from the ambient water holding portion when the valve actuator is in the first position, from the cold water tank when the valve actuator is in the second position, and from both the ambient water holding portion and the cold water tank when the valve actuator is in the third position.

20 Claims, 7 Drawing Sheets

(56) References Cited

U.S. PATENT DOCUMENTS

| | | | |
|---|---|---|---|
| 3,455,119 | A | 7/1969 | Bright |
| 3,653,807 | A | 4/1972 | Platt |
| 3,680,893 | A | 8/1972 | Giraud |
| 3,751,179 | A | 8/1973 | Wassmann |
| 3,773,432 | A | 11/1973 | Chow et al. |
| 3,836,001 | A | 9/1974 | Heldreth |
| 3,896,641 | A | 7/1975 | Worst |
| 3,953,146 | A | 4/1976 | Sowards |
| 3,975,931 | A | 8/1976 | Bischkopf |
| 4,068,870 | A | 1/1978 | Whitney et al. |
| 4,251,758 | A | 2/1981 | Pedersen et al. |
| 4,409,532 | A | 10/1983 | Hollenbeck et al. |
| 4,451,069 | A | 5/1984 | Melone |
| 4,600,361 | A | 7/1986 | Bianco |
| 4,647,082 | A | 3/1987 | Fournier et al. |
| 4,671,540 | A | 6/1987 | Medvick et al. |
| 4,804,213 | A | 2/1989 | Guest |
| 5,142,214 | A | 8/1992 | Purson et al. |
| 5,214,936 | A | 6/1993 | Lim et al. |
| 5,285,664 | A | 2/1994 | Chang et al. |
| 5,395,140 | A | 3/1995 | Wiethorn |
| 5,628,531 | A | 5/1997 | Rosenberg et al. |
| 5,658,020 | A | 8/1997 | Carman et al. |
| 5,740,835 | A | 4/1998 | Murphy |
| 5,911,750 | A | 6/1999 | Mandel et al. |
| 5,921,104 | A | 7/1999 | Chang |
| 6,070,419 | A | 6/2000 | Chang |
| 6,114,827 | A | 9/2000 | Alvaro |
| 6,207,046 | B1 | 3/2001 | Yamashita et al. |
| 6,574,979 | B2 | 6/2003 | Faqih |
| 6,574,984 | B1 | 6/2003 | McCrea et al. |
| 6,519,962 | B1 | 12/2003 | Schuetter |
| 6,672,628 | B2 | 1/2004 | Thomas et al. |
| 6,854,772 | B2 | 2/2005 | Weller et al. |
| 6,863,314 | B2 | 3/2005 | Guest |
| 6,913,294 | B2 | 7/2005 | Treverton et al. |
| 7,316,428 | B2 | 1/2008 | Takayanagi et al. |
| 7,458,171 | B1 | 12/2008 | Lentz |
| 7,510,216 | B2 | 3/2009 | Tomerlin et al. |
| 7,624,896 | B2 | 12/2009 | Doglioni Majer |
| 7,707,860 | B2 | 5/2010 | Hong et al. |
| 7,770,418 | B2 | 8/2010 | Kramme et al. |
| 7,866,182 | B2 | 1/2011 | Lim et al. |
| 8,029,024 | B2 | 10/2011 | Guest |
| 8,083,104 | B2 | 12/2011 | Roetker et al. |
| 8,171,757 | B2 | 5/2012 | Dahlke |
| 8,266,814 | B2 | 9/2012 | Grunert |
| 8,499,978 | B2 | 8/2013 | Dalchau et al. |
| 8,540,118 | B2 | 9/2013 | McDonald et al. |
| 8,656,731 | B2 | 2/2014 | Kim |
| 8,695,371 | B2 | 4/2014 | Boarman et al. |
| 8,789,854 | B2 | 7/2014 | Christian, Jr. et al. |
| 8,926,275 | B2 | 1/2015 | Badafem et al. |
| 8,991,220 | B2 | 3/2015 | Buso et al. |
| 9,010,144 | B2 | 4/2015 | Park et al. |
| 9,065,363 | B2 | 6/2015 | Marioni |
| 9,088,236 | B2 | 7/2015 | Marioni |
| 9,255,358 | B2 | 2/2016 | Kim |
| 9,273,903 | B2 | 3/2016 | Vian et al. |
| 9,309,103 | B2 | 4/2016 | Ergican et al. |
| 9,373,210 | B2 | 6/2016 | Wittern, Jr. et al. |
| 9,404,211 | B2 | 8/2016 | Hill et al. |
| 9,506,682 | B2 | 11/2016 | Yun et al. |
| 9,581,377 | B2 | 2/2017 | Kim et al. |
| 9,617,680 | B2 | 4/2017 | Kitayama et al. |
| 9,644,308 | B2 | 5/2017 | Leibman et al. |
| 9,702,078 | B2 | 7/2017 | Lee |
| 9,702,080 | B2 | 7/2017 | Lee et al. |
| 9,809,922 | B2 | 11/2017 | Salomonsson |
| 9,890,029 | B2 | 2/2018 | Comsa et al. |
| 9,903,064 | B2 | 2/2018 | Del Pos et al. |
| 9,915,468 | B2 | 3/2018 | You et al. |
| 2006/0277690 | A1 | 12/2006 | Pyo et al. |
| 2008/0087036 | A1* | 4/2008 | Tavolazzi ..... F25D 21/12 62/389 |
| 2009/0159611 | A1* | 6/2009 | Roetker ..... B67D 1/0858 222/144.5 |
| 2010/0253075 | A1 | 10/2010 | Werth |
| 2012/0032629 | A1 | 2/2012 | Peterson et al. |
| 2012/0104021 | A1* | 5/2012 | Cur ..... F25D 23/126 99/323.1 |
| 2012/0114473 | A1 | 5/2012 | Badafem et al. |
| 2012/0228871 | A1 | 9/2012 | Li |
| 2012/0246960 | A1 | 10/2012 | Lee et al. |
| 2013/0213865 | A1 | 8/2013 | Hsu et al. |
| 2013/0257043 | A1 | 10/2013 | Guest |
| 2013/0318813 | A1 | 12/2013 | Hong et al. |
| 2014/0013616 | A1 | 1/2014 | Lee et al. |
| 2014/0283542 | A1 | 9/2014 | Jang |
| 2015/0197417 | A1 | 7/2015 | Stagg et al. |
| 2015/0225226 | A1 | 8/2015 | You et al. |
| 2015/0345072 | A1 | 12/2015 | Ko et al. |
| 2016/0010271 | A1 | 1/2016 | Shin et al. |
| 2016/0059192 | A1* | 3/2016 | Jeong ..... B01F 23/2363 62/344 |
| 2016/0083238 | A1 | 3/2016 | Koo |
| 2016/0083894 | A1 | 3/2016 | Bison et al. |
| 2016/0090681 | A1 | 3/2016 | Nash et al. |
| 2016/0107874 | A1* | 4/2016 | Wang ..... B67D 3/0022 222/144.5 |
| 2016/0115643 | A1 | 4/2016 | Bison et al. |
| 2016/0138209 | A1 | 5/2016 | Kitayama et al. |
| 2016/0138849 | A1 | 5/2016 | Lee et al. |
| 2016/0201985 | A1 | 7/2016 | Lee et al. |
| 2016/0205988 | A1 | 7/2016 | Bird et al. |
| 2016/0341462 | A1 | 11/2016 | Kim |
| 2017/0037560 | A1 | 2/2017 | Shin et al. |
| 2017/0051449 | A1 | 2/2017 | Nam et al. |
| 2017/0059224 | A1 | 3/2017 | Bae et al. |
| 2017/0298563 | A1 | 10/2017 | Roetker et al. |
| 2017/0328599 | A1 | 11/2017 | Paine |
| 2017/0341920 | A1 | 11/2017 | Gonzales |

FOREIGN PATENT DOCUMENTS

| | | | |
|---|---|---|---|
| DE | 2005011732 | A1 | 7/2006 |
| EP | 0454640 | | 10/1991 |
| EP | 0682404 | A2 | 11/1995 |
| EP | 945973 | A2 | 9/1999 |
| EP | 2329757 | | 6/2011 |
| EP | 2508668 | A1 | 10/2012 |
| EP | 2620541 | A1 | 7/2013 |
| GB | 2288457 | A | 10/1995 |
| JP | S57155777 | | 9/1982 |
| JP | 2006177330 | A | 7/2006 |
| JP | 2008259665 | | 10/2008 |
| JP | 2009287527 | A | 12/2009 |
| KR | 1020110125570 | | 11/2011 |
| KR | 101588137 | | 1/2016 |
| WO | 0346451 | | 6/2003 |
| WO | 2004045351 | A1 | 6/2004 |
| WO | 20120226555 | | 2/2012 |
| WO | 2012072477 | A1 | 6/2012 |
| WO | 2012146534 | A2 | 11/2012 |
| WO | 2014115976 | A1 | 7/2014 |
| WO | 2015010731 | | 1/2015 |
| WO | 2016204414 | | 12/2016 |
| WO | 2017023122 | | 2/2017 |

* cited by examiner

REFRIGERATION WATER DISPENSING SYSTEM

CROSS-REFERENCE TO RELATED APPLICATIONS

This application claims priority to U.S. patent application Ser. No. 15/873,554, filed Jan. 17, 2018, now U.S. Pat. No. 10,697,700, entitled REFRIGERATION WATER DISPENSING SYSTEM, the contents of which are hereby incorporated by reference in its entirety.

FIELD OF DISCLOSURE

The present device generally relates to a water dispenser, and more specifically, to a water dispenser used in a refrigerator and configured to produce ambient water, cold water, and a mixture of the ambient water and the cold water.

BACKGROUND

Currently, many refrigeration appliances are configured to deliver water through a water dispenser mounted on or within the refrigeration appliance. Some water dispensers may be sourced from a tank disposed within the refrigeration appliance. Other water dispensers may be sourced directly from an inlet water source. Regardless of the source, improve and more efficient methods of controlling and delivering the temperature of the water dispensed by such water dispensers are desired.

SUMMARY

In at least one aspect, a water dispensing system for use in a refrigeration appliance includes a three-way connector operably coupled to an inlet water source and configured to direct incoming water from the inlet water source into an ambient water holding portion and a cold water tank. A water dispenser is coupled with said refrigeration appliance. A three-way water control valve is configured to provide water to the water dispenser from at least one of the ambient water holding portion and the cold water tank. A valve actuator is slidable between a first position, a second position, and a third position. The three-way water control valve is configured to provide water from the ambient water holding portion when the valve actuator is in the first position. The three-way water control valve is configured to provide water from the cold water tank when the valve actuator is in the second position. The three-way water control valve is configured to provide water from both the ambient water holding portion and the cold water tank when the valve actuator is in the third position.

In at least another aspect, a water dispensing system includes a three-way connector operably coupled to an inlet water source, an ambient water holding portion, and a cold water tank. A three-way water control valve is configured to direct water from at least one of the ambient water holding portion and the cold water tank to a water dispenser. The three-way water control valve includes a housing having first and second valve inlets. A valve actuator is operable between a first position, a second position, and a third position. A gasket holder is movable between a first position, a second position, and a third position. The first, second, and third positions of the gasket holder correspond with the first, second, and third positions of the valve actuator, respectively.

In at least another aspect, a method of making a water dispensing system includes the steps of coupling a three-way connector with an ambient water holding portion and a cold water tank to direct water to each of the ambient water holding portion and the cold water tank, configuring the ambient water holding portion to retain water at a first temperature, and configuring the cold water tank to retain water at a second temperature. The second temperature is lower than the first temperature. The method further includes the steps of coupling a first valve inlet of a three-way water control valve with the ambient water hold portion and coupling a second valve inlet of the three-way water control valve with the cold water tank. Another step of the method includes positioning a slidable member to at least partially close one of the first valve inlet and the second valve inlet. The method also includes the step of coupling a valve actuator with the slidable member and the three-way water control valve such that the valve actuator is slidable between a first position, a second position, and a third position. The first valve inlet is closed when the valve actuator is in the first position, each of the first and second valve inlet are at least partially open when the valve actuator is in the second position, and the second valve inlet is closed when the valve actuator is in the third position.

These and other features, advantages, and objects of the present device will be further understood and appreciated by those skilled in the art upon studying the following specification, claims, and appended drawings.

BRIEF DESCRIPTION OF THE DRAWINGS

In the drawings:

FIG. 5B is an exploded perspective view of the three-way water control valve provided in

FIG. 5A;

DETAILED DESCRIPTION OF THE EMBODIMENTS

Figure 1:
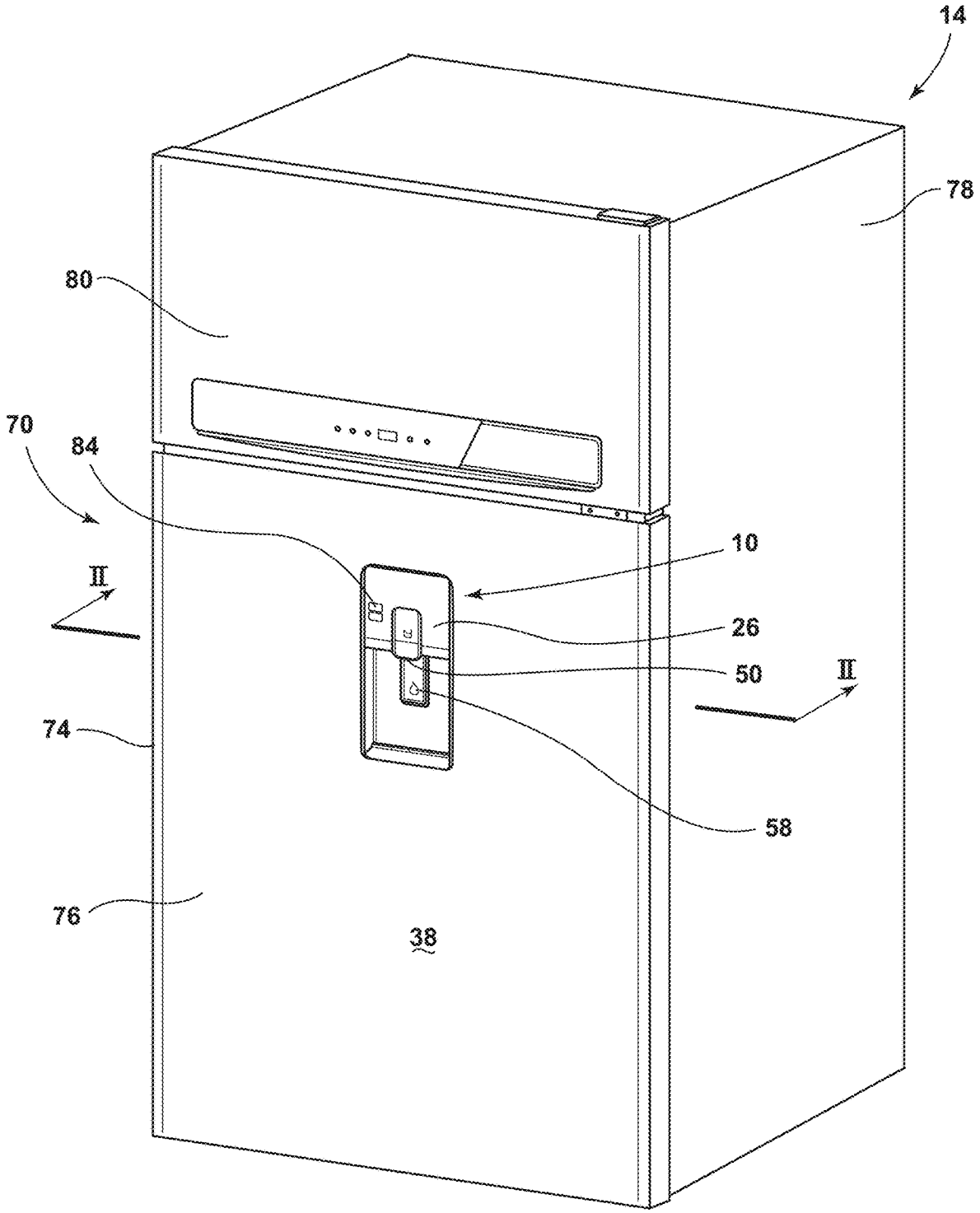
FIG. 1 is a perspective view of a refrigeration appliance including a water dispenser according to some embodiments of the current disclosure.

For purposes of description herein the terms "upper," "lower," "right," "left," "rear," "front," "vertical," "horizontal," and derivatives thereof shall relate to the device as oriented in FIG. 1. However, it is to be understood that the device may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

As used herein, the term "and/or," when used in a list of two or more items, means that any one of the listed items can be employed by itself, or any combination of two or more of the listed items can be employed. For example, if a composition is described as containing components A, B, and/or C, the composition can contain A alone; B alone; C alone; A and B in combination; A and C in combination; B and C in combination; or A, B, and C in combination.

Referring to FIGS. 1-6C, a water dispensing system 10 for use in a refrigeration appliance 14 is shown. The water dispensing system 10 comprises a three-way connector 18 operably coupled to an inlet water source 22 and a water dispenser 26. The three-way connector 18 is configured to direct incoming water from the inlet water source 22 into an ambient water holding portion 30 and a cold water tank 34. The water dispenser 26 is disposed on a front surface 38 of said refrigeration appliance 14 and comprises a three-way water control valve 46 configured to control the flow of water from the ambient water holding portion 30 and the cold water tank 34, a valve actuator 84 operable between a first position, a second position, and a third position, wherein each position corresponds to a predetermined temperature of water to be dispensed, and a dispenser actuator 58.

Referring now to FIG. 1, the refrigeration appliance 14 includes a cabinet 70 that defines a refrigeration chamber 74, selectively closeable by a refrigeration chamber door 76, and a freezer chamber 78, selectively closeable by a freezer chamber door 80. The refrigeration chamber 74 and the freezer chamber 78 may act as storage compartments within the cabinet 70. A water dispenser 26 may be disposed on or in the refrigeration chamber door 76 and includes a dispenser outlet 50, a valve actuator 84, and a dispenser actuator 58. In FIG. 1, a top-mount refrigeration appliance 14 is shown with the refrigeration chamber 74 positioned beneath the freezer chamber 78. Although a top-mount design for the refrigeration appliance 14 is shown in FIG. 1, the general configuration is not meant to be limiting and other refrigerator styles and configurations are contemplated. For example, the refrigeration appliance 14 could be a side-by-side refrigeration appliance, a bottom-mount refrigeration appliance, a refrigeration appliance that includes only a refrigeration chamber and no freezer chamber, etc.

Figure 2:
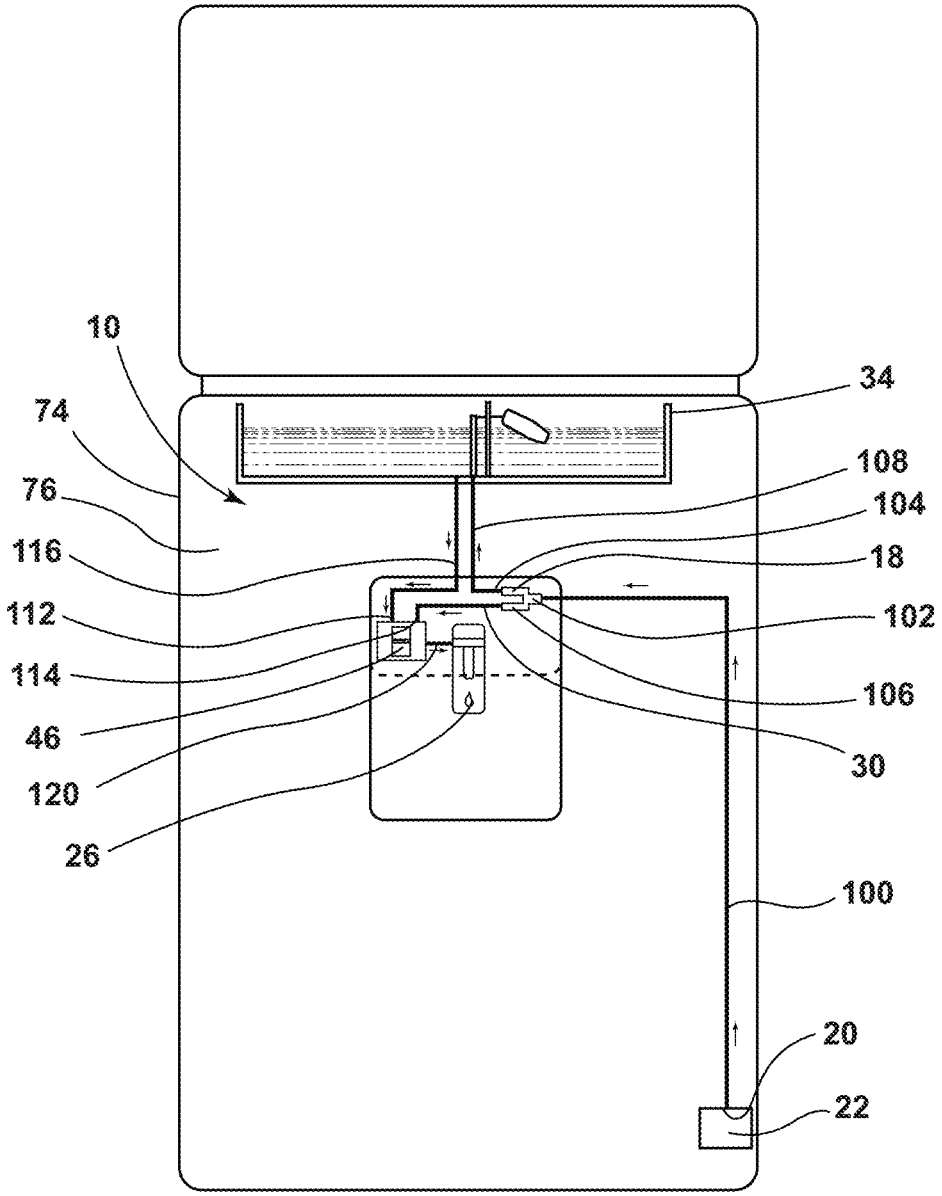
FIG. 2 is a schematic diagram of water flow through a refrigeration chamber door taken along the line II-II of FIG. 1 according to some embodiments of the current disclosure.

Referring now to FIG. 2, a schematic drawing is shown having exemplary flow paths for water being directed through the water dispensing system 10 where the water dispensing system 10 is disposed within the refrigeration chamber door 76 as provided in FIG. 1. An inlet tubing 100 may direct water from the inlet water source 22 to the three-way connector 18. In the illustrated embodiment, a compressor 20 may be used to pump incoming water through the inlet tubing 100 until it reaches the three-way connector 18 where the inlet tubing 100 may be operably coupled to a connection inlet 102. Although the compressor 20 and the inlet water source 22 are shown disposed together at the bottom right of the refrigerator chamber door 76, it is contemplated that the compressor 20 and/or the inlet water source 22 may be located anywhere within or on the refrigeration appliance 14 without departing from the scope of the present disclosure. For example, the compressor 20 may be located at the rear of the refrigeration appliance 14, on the bottom of the refrigeration appliance 14, etc., while the inlet water source 22 may be located on the top of the refrigeration chamber door 76, on the side of the cabinet 70, at the rear of the refrigeration appliance 14, etc. Further, the compressor 20 may be connected to the inlet water source 22 by a tubing or other conduit as disclosed elsewhere herein.

The three-way connector 18 is configured to split the incoming water between a first connection outlet 104 and a second connection outlet 106. The first connection outlet 104 is operably coupled to the cold water tank 34 by a tank tubing 108. The tank tubing 108 is configured to direct the water into the cold water tank 34 disposed on the refrigeration chamber door 76. The cold water tank 34 houses the water, which is cooled by the refrigeration chamber 74. The cold water tank 34 is operably coupled to a first valve inlet 112. As shown in FIG. 2, the cold water tank 34 may be operably coupled to the three-way water control valve 46 by a cold water holding portion 116. The cold water holding portion 116 may be a tubing, a reservoir, or any other container known in the art. Further, it is contemplated that the cold water tank 34 may be connected to the three-way water control valve 46 in any way that allows water to flow between the cold water tank 34 and the three-way water control valve 46. For example, the cold water tank 34 may be directly connected to the three-way water control valve 46 or connected to the cold water holding portion 116.

Still referring to FIG. 2, the second connection outlet 106 is operably coupled to an ambient water holding portion 30. The ambient water holding portion 30 may be a tubing, a reservoir, or any other general type of container known in the art and is configured to direct the water to a second valve inlet 114 of the three-way water control valve 46. The three-way water control valve 46 is operable between a first position, a second position, and a third position. Each position corresponds to a different temperature of the dispensed water. In some embodiments, water of the desired temperature is directed through a dispenser tubing 120 to the water dispenser 26. Alternatively, it is contemplated that, in some embodiments, the three-way water control valve 46 may be coupled to the water dispenser 26 directly, through a water purifier, without departing from the scope of the present disclosure. The water purifier may be any purifier known in the art and may be disposed in any position along the water flow path to the dispenser. For example, depending on the design or type of purifier used, the purifier may be operably coupled to the three-way water control valve 46, to the water dispenser 26, to the inlet water source 22, to the three-way connector 18, etc.

Figure 3A:
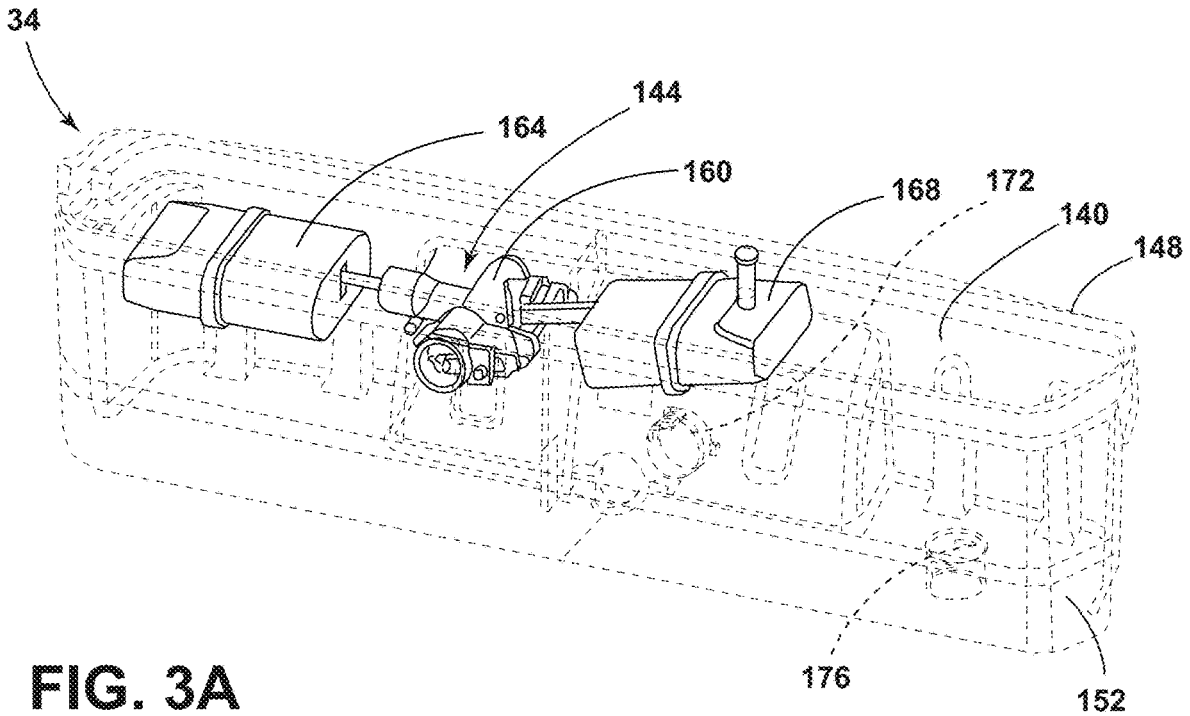
FIG. 3A is a schematic side perspective view of a water tank having a dual-float valve system according to some embodiments of the current disclosure.
Figure 3B:
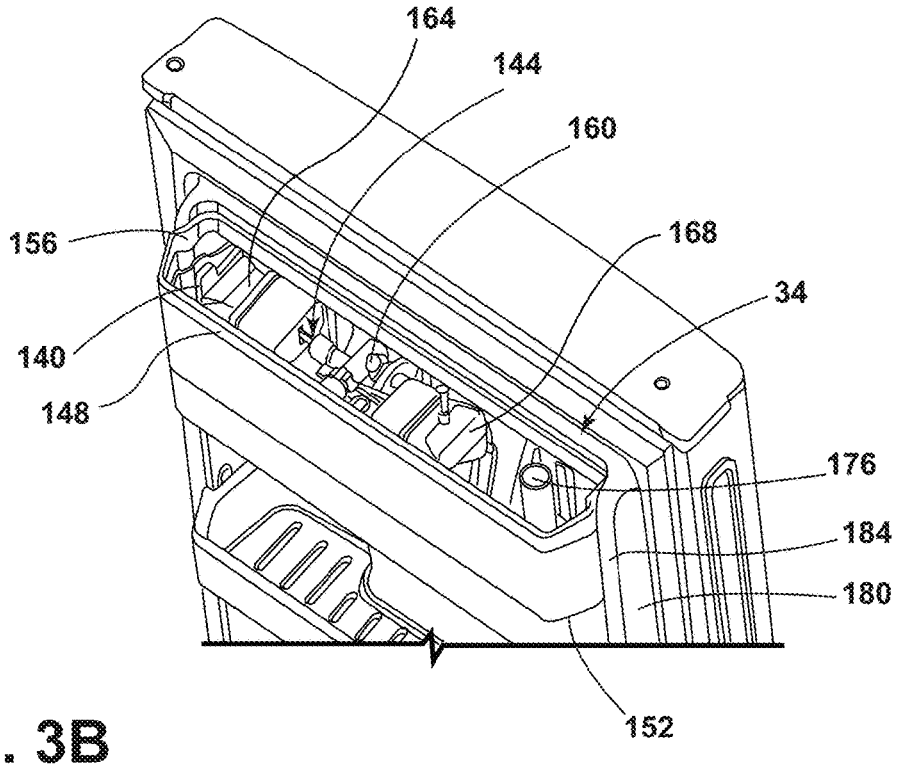
FIG. 3B is a top perspective view of an interior surface of the refrigeration chamber door including the tank of FIG. 3A according to some embodiments of the current disclosure.

Referring now to FIGS. 3A and 3B, the cold water tank 34 is shown including a cold water reservoir 140 and a dual-float valve system 144. The reservoir 140 includes a reservoir perimeter wall 148 and a bottom surface 152. Further, in some embodiments, a tank cover 156 may be secured over the reservoir 140 (FIG. 3B). The dual-float valve system 144 includes a valve body 160 operably coupled to a first float valve 164 and a second float valve 168. The dual-float valve system 144 is configured to control the flow of water to the cold water tank 34 through both a tank inlet 172 and a tank outlet 176. The dual-float valve system 144 may also be used to stop the flow of water once the water level reaches a predetermined level. As shown in FIG. 3B, the cold water tank 34 may be disposed on an interior surface 180 of the refrigeration chamber door 76. In the illustrated embodiment, the cold water tank 34 is disposed on a top portion 184 of the refrigeration chamber door 76. Alternatively, the cold water tank 34 may be located in any position within or on the refrigeration appliance 14 including, for example, an interior surface of the cabinet 70, a bottom portion of the refrigeration chamber door 76, etc., without departing from the scope of the present disclosure. The cold water tank 34 may be configured to be cooled by any known refrigeration process known in the art. While the dual-float valve system 144 is shown in the illustrated embodiment, other configurations of water tanks are contemplated. For example, the cold water tank 34 may be an insulated tank, a water reservoir, etc., without departing from the scope of the present disclosure.

Figure 4:
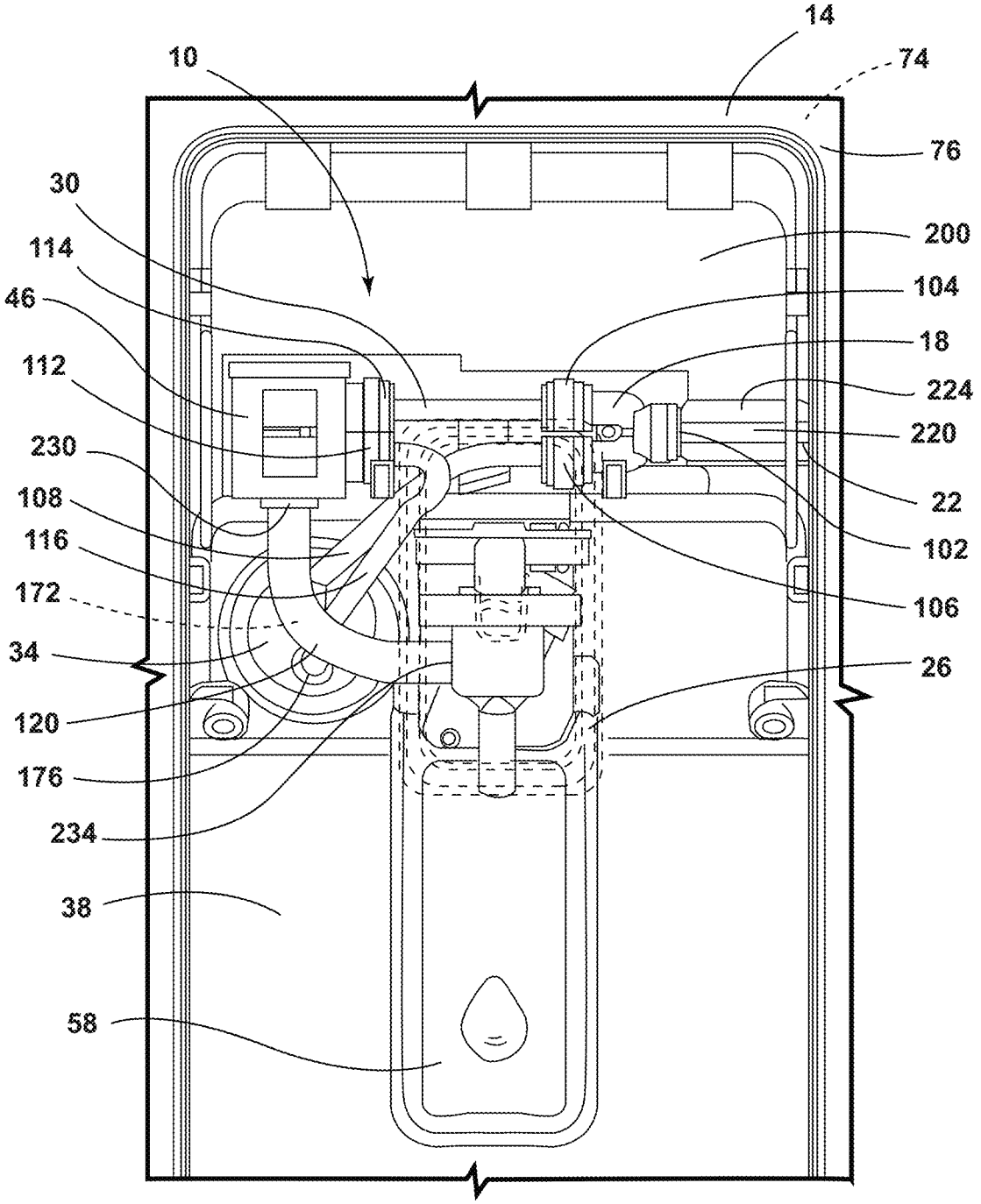
FIG. 4 is a front cross-sectional view of the refrigeration chamber door and the water dispenser according to some embodiments of the current disclosure.

Referring now to FIG. 4, a cavity 200 is defined by the refrigeration chamber door 76. The water dispensing system 10 is disposed within the cavity 200 so that the dispenser actuator 58 may be engaged by a user from the front of the refrigeration appliance 14. In the illustrated embodiment, the dispenser actuator 58 is configured to actuate the dispenser when the actuator 58 is pressed toward the refrigeration chamber 74. However, it is contemplated that other styles and configurations of actuators may be used as the dispenser actuator 58 without departing from the scope of the present disclosure. For example, the dispenser actuator 58 could be a paddle as shown in the illustrated embodiment, or the dispenser actuator 58 may be a button, a capacitive switch, a touch screen, a sensor, etc.

Still referring to FIG. 4, incoming tubing 220 guides water into the three-way connector 18. The incoming tubing 220 is disposed within a guiding channel 224 defined by the refrigeration chamber door 76. The guiding channel 224 leads into the cavity 200 so the incoming tubing 220 is operably coupled to the three-way connector 18. The three-way connector 18 includes the connection inlet 102, the first connection outlet 104, and the second connection outlet 106. In the illustrated embodiment, the three-way connector 18 is a three-way quick connector where a coupling is used to provide a fast connection using connection surfaces that engage and prevent separation. However, it is contemplated that any connector having a connection inlet, a first outlet, and a second outlet could be used without departing from the scope of the present disclosure.

Referring still to FIG. 4, the three-way water control valve 46 includes the first valve inlet 112, the second valve inlet 114, and the valve outlet 230. The second valve inlet 114 is operably coupled to the first connection outlet 104 by the ambient water holding portion 30. The second connection outlet 106 is operably coupled to the tank inlet 172 of the cold water tank 34 by the tank tubing 108. The tank outlet 176 of the cold water tank 34 is operably coupled to the first valve inlet 112 by the cold water holding portion 116. The cold water holding portion 116 and the ambient water holding portion 30 supply water to the three-way water control valve 46. The water is then dispensed through the valve outlet 230 and further through the water dispenser 26. The valve outlet 230 is operably coupled to a water dispenser inlet 234 by the dispenser tubing 120. In the illustrated embodiment, quick snap fittings are shown for the first connection outlet 104, the second connection outlet 106, and the connection inlet 102. Further, the illustrated embodiment shows quick snap fittings for the first valve inlet 112, the second valve inlet 114, and the valve outlet 230, as well as the water dispenser inlet 234. However, it is contemplated that alternate fittings may be used without departing from the scope of the present disclosure.

The three-way water control valve 46 controls the flow of water from the ambient water holding portion 30 and the cold water tank 34 to the water dispenser 26. The ambient water housed by the ambient water holding portion 30 may be within a range of about 35 degrees Celsius to about 25 degrees Celsius. The water may be sourced directly from a tap water line or from any other ambient water source known in the art. The cold water housed by the cold water tank 34 may be within a range of about 15 degrees Celsius to about 5 degrees Celsius. As disclosed elsewhere herein, the cold water tank 34 is cooled by the refrigeration process of the refrigeration appliance 14.

The three-way water control valve 46 may also produce a mixture of ambient water and cold water. The temperature of the mixture may be within the range of about 25 degrees Celsius to about 15 degrees Celsius. In the illustrated embodiment, the three-way water control valve 46 allows a 50:50 mixture of ambient water and cold water. However, it is contemplated that other ratio mixtures could be used such as 10:90, 20:80, 30:70, 40:60, 60:40, 70:30, 80:20, 90:10, or any intermediate values. Further, while the illustrated embodiment produces three distinct temperatures, it is contemplated that the three-way water control valve 46 may produce multiple temperatures without departing from the scope of the present disclosure.

Figure 5A:
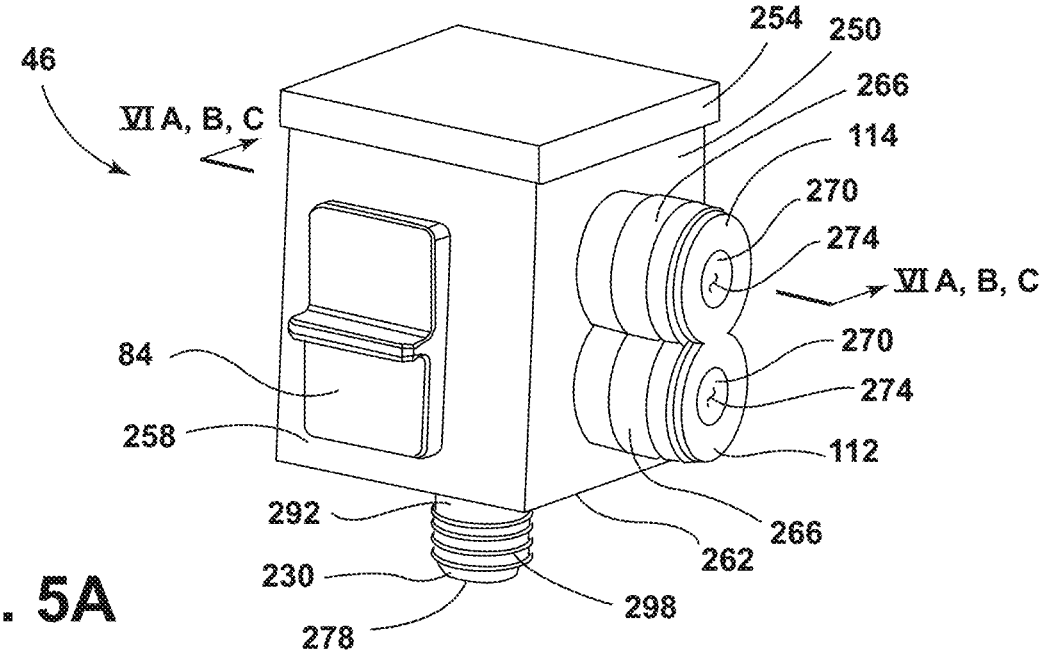
FIG. 5A is a perspective view of a three-way water control valve according to some embodiments of the current disclosure.

Referring now to FIG. 5A, the three-way water control valve 46 is shown assembled. The three-way water control valve 46 includes the valve actuator 84, the first valve inlet 112, the second valve inlet 114, and the valve outlet 230. The three-way water control valve 46 also includes a housing 250 operably coupled to a valve cover 254. The valve cover 254 may be coupled to the housing 250 using any technique known in the art, including, for example, welding, adhesive, etc. The housing 250 includes a housing perimeter wall 258 and a bottom surface 262. The first valve inlet 112 and the second valve inlet 114 may be integrally formed or individually formed and separate depending on the configuration of the three-way water control valve 46. Each of the first valve inlet 112 and the second valve inlet 114 includes an inlet perimeter wall 266 with an interior connection face 270. Each interior connection face 270, together with the inlet perimeter wall 266, defines an inlet opening 274 configured to receive an end of a tubing and direct water flow into the three-way water control valve 46. The three-way water control valve 46 further includes the valve outlet 230. The valve outlet 230 includes an outlet opening 278 defined by an outlet perimeter wall 292. The outlet perimeter wall 292 includes a threaded outer surface 298 to provide a quick connection and extends from the bottom surface 262 of the housing 250. The valve outlet 230 may be integrally formed with the housing 250 and is configured to allow water flow out of the three-way water control valve 46.

Figure 5B:
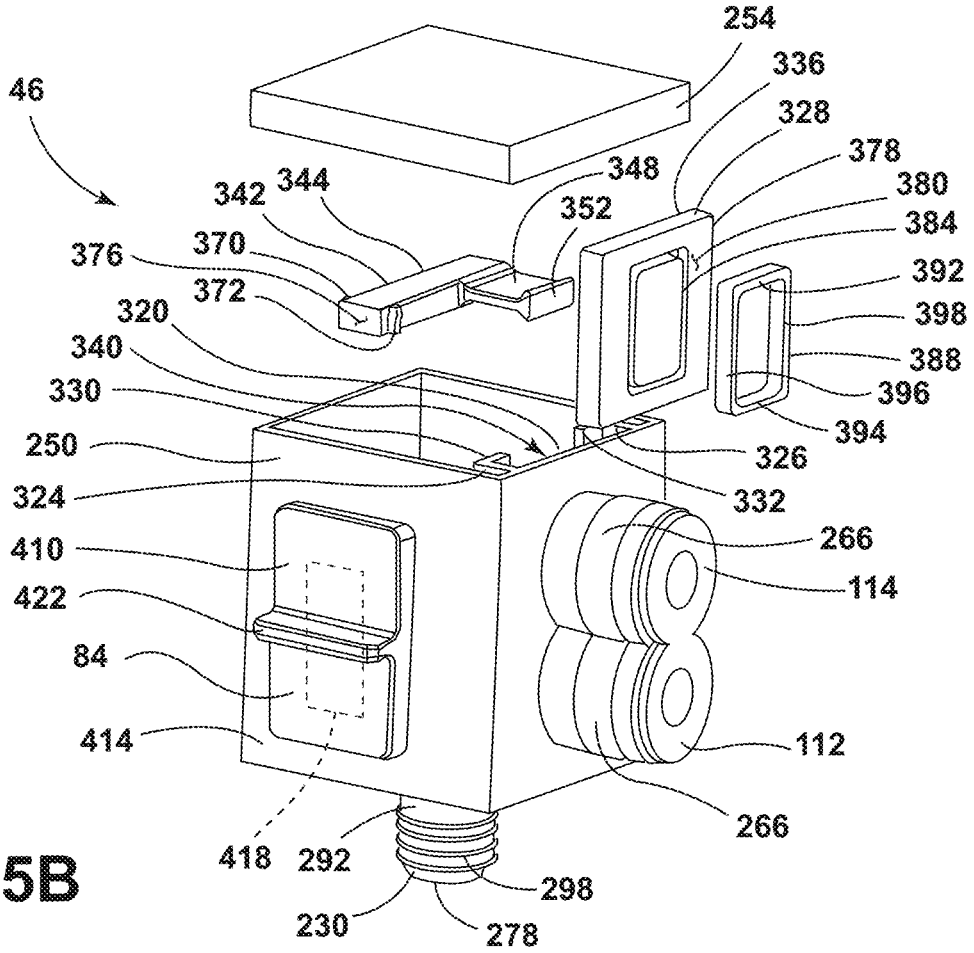

Referring now to FIG. 5B, an exploded view of the three-way water control valve 46 is provided. A guide assembly 320 includes first and second sidewalls 324, 326. The first and second sidewalls 324, 326 are integrally formed with the housing perimeter wall 258. The first and second sidewalls 324, 326 are configured to frame the first valve inlet 112 and the second valve inlet 114. Further, the sidewalls 324, 326 are configured to guide a gasket holder 328 between the first valve inlet 112 and the second valve inlet 114. A first protrusion 330 extends from the first sidewall 324 while a second protrusion 332 extends from the second sidewall 326. The protrusions 330, 332 are configured to secure the gasket holder 328 in place. When the gasket holder 328 is engaged with the guide assembly 320, the first and second protrusions 330, 332 are substantially flush with a rear surface 336 of the gasket holder 328, and the first and second protrusions 330, 332 define a slot 340 having a width. An actuator arm 342 is operably coupled to the rear surface 336 of the gasket holder 328 and includes a primary arm 344 and a secondary arm 348. The secondary arm 348 extends perpendicularly from the primary arm 344. The secondary arm 348 is operably coupled to the rear surface 336 of the gasket holder 328 by a foot 352 extending vertically and horizontally from the secondary arm 348. The horizontal dimensions of the foot 352 may be as wide as the width of the slot 340. The vertical dimensions may be varied to be positioned or coupled within an aperture 356 (FIGS. 6A-6C) defined by the rear surface 336 of the gasket holder 328. The aperture 356 may be of any shape and size, and the foot 352 may be of any shape and size configured to be received by the aperture 356.

Still referring to FIG. 5B, the primary arm 344 of the actuator arm 342 includes a first prong 370 and a second prong 372. The first and second prongs 370, 372 are perpendicular to a front surface 376 of the actuator arm 342. The prongs 370, 372 are configured to engage with the valve actuator 84 to secure the actuator arm 342 to the valve actuator 84. This allows the actuator arm 342 to be slidably moved in conjunction with the valve actuator 84 and to subsequently move the gasket holder 328 in the same manner.

Referring still to FIG. 5B, the gasket holder 328 is a plate 378 including a front surface 380 and the rear surface 336. The front surface 380 defines a gasket channel 384 configured to receive a gasket 388. In the illustrated embodiment, the gasket 388 may include a top side 392 and a bottom side 394 joined by first and second lateral sides 396, 398. While the gasket 388 in the illustrated embodiment is of a generally rectangular shape, it is contemplated that the gasket may be any size or shape without departing from the scope of the present disclosure.

Still referring to FIG. 5B, the position of the gasket 388 and the gasket holder 328 is determined by the position of the valve actuator 84. The valve actuator 84 includes a front plate 410 disposed substantially flush to an outer surface 414 of the housing perimeter wall 258. The primary arm 344 extends through a housing opening 418 of the housing perimeter wall 258 to allow slideable movement of the valve actuator 84 upward and downward. The valve actuator 84 further includes a protrusion 422 configured to allow a user to apply a force in an upward or downward direction to change the position of the valve actuator 84. While a bar handle is shown in the illustrated embodiment, it is contemplated that any handle configured to facilitate movement of the valve actuator 84 could be used, such as, for example, a knob.

Figure 6A:
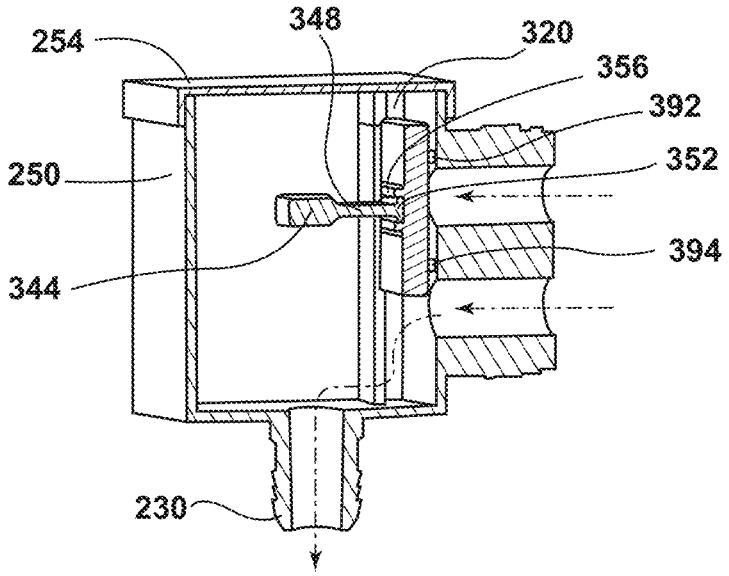
FIG. 6A is a cross-sectional view of the three-way water control valve in a first position taken along the line VIA-VIA of FIG. 5A.
Figure 6B:
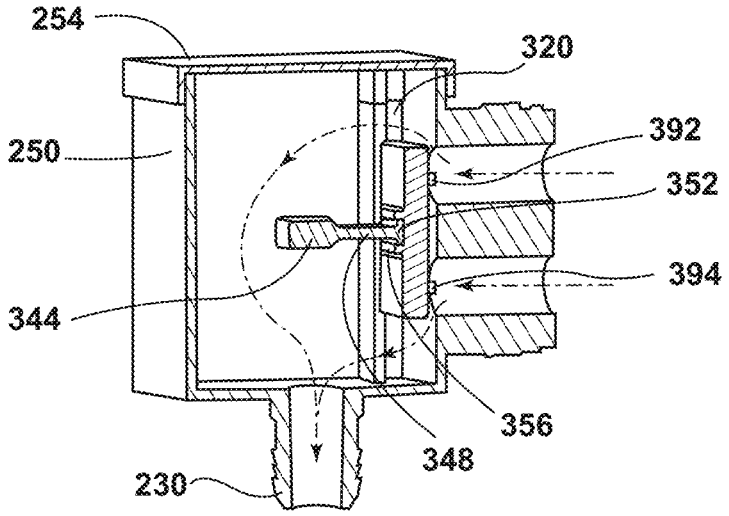
FIG. 6B is a cross-sectional view of the three-way water control valve in a second position taken along the line VIB-VIB of FIG. 5A.
Figure 6C:
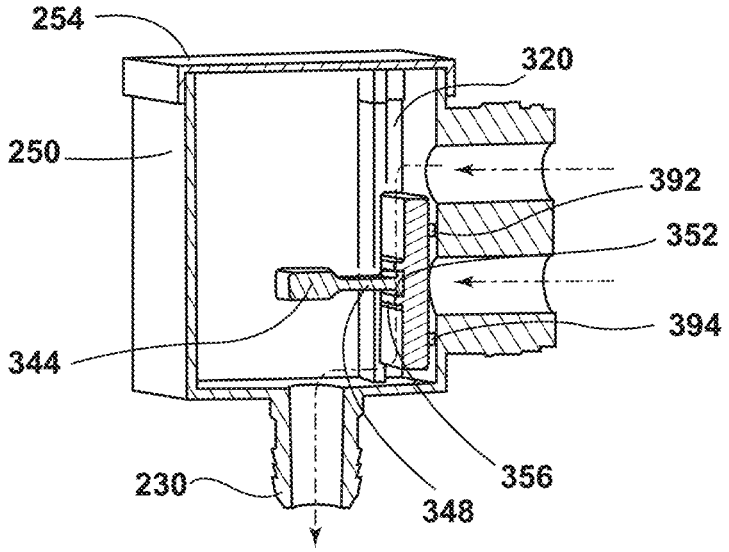
FIG. 6C is a cross-sectional view of the three-way water control valve in a third position taken along the line VIC-VIC of FIG. 5A.

Referring now to FIGS. 6A-6C, the valve actuator 84 is shown slideably coupled to the housing 250. The valve actuator 84, the gasket holder 328, and the gasket 388 are movable between the first position (FIG. 6A), the second position (FIG. 6B), and the third position (FIG. 6C). The sides 396, 398 of the gasket 388 extend a distance to allow some portion of the sides 396, 398 to protrude from the gasket channel 384 of the gasket holder 328 when the gasket 388 is fully engaged with the gasket channel 384. Referring now to FIG. 6A, the valve actuator 84 is provided in the first position. The first position corresponds to the gasket holder 328 being disposed in a fully raised position. When the gasket holder 328 is in the fully raised position, the gasket 388 blocks incoming water from the second valve inlet 114. This allows only ambient water flow through the first valve inlet 112 from the ambient water holding portion 30, as shown in FIG. 6A. The cold water remains stored in the cold water tank 34 and the cold water holding portion 116. The temperature of water delivered to the user while the valve actuator 84 is in the first position is within the range of about 35 degrees Celsius to about 25 degrees Celsius.

Referring now to FIG. 6B, the valve actuator 84 is shown in the second position. The second position corresponds to the gasket holder 328 being disposed in a middle position. When the gasket holder 328 is in the middle position, the gasket 388 is positioned between the first valve inlet 112 and the second valve inlet 114. This position allows water to flow around the gasket 388 on either side, as shown in FIG. 6B. This produces a mixture of ambient water and cold water in at least one of the variations of the warm/ratio disclosed herein. The temperature of the mixture of water delivered to the user while the valve actuator 84 is in the first position is within the range of about 25 degrees Celsius to about 15 degrees Celsius.

Referring now to FIG. 6C, the valve actuator 84 is shown in the third position. The third position corresponds to the gasket holder 328 being disposed in a fully lowered position. When the gasket holder 328 is in the fully lowered position, the gasket 388 blocks incoming water from the first valve inlet 112. This allows only cold water to flow through the second valve inlet 114 from the cold water holding portion 116, as shown in FIG. 6C. The ambient water remains stored in the ambient water holding portion 30. The temperature of water delivered to the user while the valve actuator 84 is in the third position is within the range of about 5 degrees Celsius to about 15 degrees Celsius. While FIGS. 6A, 6B, and 6C illustrated exemplary positions of the gasket holder 328 and the gasket 388, it is contemplated that other combinations are possible with various settings of warm and cold water temperatures and/or temperature ranges.

Figure 7:
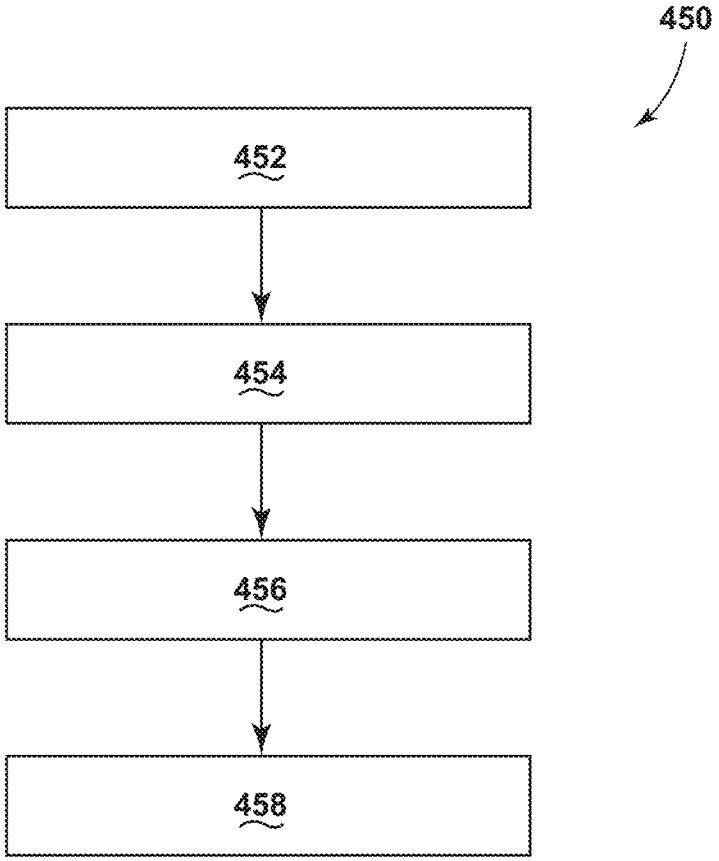
FIG. 7 is a flow diagram of a method for making a water dispenser according to one aspect of the present disclosure.

Referring now to FIG. 7, with continued reference to FIGS. 1-6C, a method 450 of making a water dispenser 26 is shown. The method 450 may begin with a step 452 that includes positioning the three-way connector 18, the three-way water control valve 46, the cold water tank 34, and the valve actuator 84 into the cavity 200 defined by the refrigeration chamber door 76. The water dispensing system 10 is disposed within the cavity 200 so that the dispenser actuator 58 may be engaged by a user from the front of the refrigeration appliance 14.

Next is a step 454 of operably coupling the inlet water source 22 to the ambient water holding portion 30 and the cold water tank 34 using the three-way connector 18. The three-way connector 18 includes the connection inlet 102, the first connection outlet 104, and the second connection outlet 106.

Next is a step 456 of operably coupling the cold water tank 34 and the ambient water holding portion 30 to the three-way water control valve 46 to allow water to flow from the ambient water holding portion 30 and the cold water tank 34 to the three-way water control valve 46. As shown in FIGS. 1-6C, the ambient water holding portion 30, the water tank 34, and the water dispenser 26 may be coupled by various connectors such as tubing. However, it is understood that the connectors may also be pipes, conduits, channels, ducts, etc. without departing from the scope of the disclosure.

Next is a step 458 of directing ambient water from the ambient water holding portion 30, cold water from the cold water tank 34, and a mixture of water from the ambient water holding portion 30 and the cold water tank 34 to a water dispenser 26 using the three-way water control valve 46 and the valve actuator 84.

The method may further include a step 460 of positioning a gasket holder 328 within a guide assembly 320 of the three-way water control valve 46. Next is a step 462 of positioning a gasket 388 within a channel 384 of the gasket holder 328, wherein the gasket 388 is selectively engageable with one of a first valve inlet 112 and a second valve inlet 114. The position of the gasket 388, in relation to the first valve inlet 112 and the second valve inlet 114, determines the temperature of the water dispensed by the water dispenser 26.

The method may further include a step 464 of engaging the gasket 388 with the second valve inlet 114 to produce water at a first temperature, wherein the first temperature is within the range of about 35 degrees Celsius to about 25 degrees Celsius. The method may also include a step 466 of engaging a portion of the gasket 388 with each of the first valve inlet 112 and the second valve inlet 114 to produce water at a second temperature, wherein the second temperature is within the range of about 25 degrees Celsius to about 15 degrees Celsius. The method may also include a step engaging the gasket 388 with the first valve inlet 112 to produce water at a third temperature, wherein the third temperature is within the range of about 15 degrees Celsius to about 5 degrees Celsius.

The method may further include a step 470 of installing a water purifier as the inlet water source 22. The water purifier is operably coupled to the three-way water control valve 46. The water purifier may be any water purifier known in the art. Further, it is contemplated that the water purifier may be installed further along the line without replacing the inlet water source 22 without departing from the scope of the present disclosure. Further, it is contemplated, although the steps are listed in a particular order, they may be performed in any order or with two or more steps being performed concurrently without departing from the scope of the present disclosure.

It will be understood by one having ordinary skill in the art that construction of the described device and other components is not limited to any specific material. Other exemplary embodiments of the device disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the device as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present device. The exemplary structures and processes disclosed herein are for illustrative purposes and are not to be construed as limiting.

It is also to be understood that variations and modifications can be made on the aforementioned structures and methods without departing from the concepts of the present device, and further it is to be understood that such concepts are intended to be covered by the following claims unless these claims by their language expressly state otherwise.

The above description is considered that of the illustrated embodiments only. Modifications of the device will occur to those skilled in the art and to those who make or use the device. Therefore, it is understood that the embodiments shown in the drawings and described above is merely for illustrative purposes and not intended to limit the scope of the device, which is defined by the following claims as interpreted according to the principles of patent law, including the Doctrine of Equivalents.

What is claimed is:

1. A water dispensing system for a refrigeration appliance, comprising:

a three-way connector operably coupled to an inlet water source and configured to direct incoming water from the inlet water source into an ambient water holding portion and a cold water tank;

a water dispenser coupled with said refrigeration appliance;

a three-way water control valve configured to provide water to the water dispenser from at least one of the ambient water holding portion and the cold water tank; and a valve actuator slidable between a first position, a second position, and a third position, wherein the three-way water control valve is configured to provide water from:

the ambient water holding portion when the valve actuator is in the first position;

the cold water tank when the valve actuator is in the second position; and the ambient water holding portion and the cold water tank when the valve actuator is in the third position.

2. The water dispensing system of claim 1, further comprising:

a sealing assembly coupled with an actuator arm extending from the valve actuator, wherein the sealing assembly at least partially blocks water from flowing from one or both of the ambient water holding portion and the cold water tank.

3. The water dispensing system of claim 1, wherein the three-way connector includes a connection inlet, a first connection outlet, and a second connection outlet, and further wherein the first connection outlet is operably coupled to the cold water tank and the second connection outlet is operably coupled to the ambient water holding portion.

4. The water dispensing system of claim 3, further comprising:

a compressor configured to pump incoming water from the inlet water source to the connection inlet of the three-way connector.

5. The water dispensing system of claim 1, further comprising:

a water purifier operably coupled to the three-way water control valve.

6. The water dispensing system of claim 1, wherein the cold water tank includes a cold water reservoir and a dual-float valve system configured to maintain a predetermined water level within the cold water tank.

7. The water dispensing system of claim 1, wherein the valve actuator is positioned on an exterior surface of said refrigeration appliance, and further wherein the valve actuator is positioned proximate the water dispenser.

8. A water dispensing system comprising:

a three-way connector operably coupled to an inlet water source, an ambient water holding portion, and a cold water tank;

a three-way water control valve configured to direct water from at least one of the ambient water holding portion and the cold water tank to a water dispenser, the three-way water control valve including:

a housing having first and second valve inlets;

a valve actuator operable between a first position, a second position, and a third position;

a gasket holder movable between a first position, a second position, and a third position, wherein the first, second, and third positions of the gasket holder correspond with the first, second, and third positions of the valve actuator, respectively.

9. The water dispensing system of claim 8, further comprising:

a gasket operably coupled with the gasket holder and positioned to seal at least one of the first and second valve inlets.

10. The water dispensing system of claim 9, wherein the gasket has a substantially square shape.

11. The water dispensing system of claim 8, wherein the three-way water control valve includes an actuator arm extending between the valve actuator and the gasket holder.

12. The water dispensing system of claim 11, wherein the actuator arm includes a first portion coupled with the valve actuator and a second portion coupled with the gasket holder.

13. The water dispensing system of claim 11, wherein the actuator arm is substantially L-shaped.

14. The water dispensing system of claim 11, wherein the actuator arm includes a foot operably coupled with the gasket holder.

15. The water dispensing system of claim 8, wherein the housing includes a guide assembly having first and second sidewalls framing the first and second valve inlets, and wherein the guide assembly includes protrusions extending from the first and second sidewalls and configured to guide the gasket holder between the first, second, and third positions.

16. The water dispensing system of claim 8, wherein further comprising a refrigeration appliance configured to house at least the three-way connector and the three-way water control valve.

17. A method of making a water dispensing system comprising steps of:

coupling a three-way connector with an ambient water holding portion and a cold water tank to direct water to each of the ambient water holding portion and the cold water tank;

configuring the ambient water holding portion to retain water at a first temperature;

configuring the cold water tank to retain water at a second temperature, the second temperature lower than the first temperature;

coupling a first valve inlet of a three-way water control valve with the ambient water holding portion;

coupling a second valve inlet of the three-way water control valve with the cold water tank;

positioning a slidable member to at least partially close one of the first valve inlet and the second valve inlet; and coupling a valve actuator with the slidable member and the three-way water control valve such that the valve actuator is slidable between a first position, a second position, and a third position, wherein the first valve inlet is closed when the valve actuator is in the first position, and wherein each of the first and second valve inlet are at least partially open when the valve actuator is in the second position, and further wherein the second valve inlet is closed when the valve actuator is in the third position.

18. The method according to claim 17, further comprising:

coupling a gasket with the slidable member, wherein the gasket is configured to at least partially seal one of the first and second valve inlets.

19. The method according to claim 17, further comprising:

configuring the slidable member to partially obstruct each of the first and second valve inlets to allow water to flow from the ambient water holding portion and the cold water tank when the valve actuator is in the second position, wherein the water from the ambient water holding portion and the cold water tank are combined by the three-way water control valve to produce water at a third temperature, and wherein the third temperature is between the first and second temperatures.

20. The method according to claim 17, further comprising:

installing a water purifier, the water purifier operably coupled to the three-way water control valve.

* * * * *